US012084851B2

(12) United States Patent
Verberne et al.

(10) Patent No.: US 12,084,851 B2
(45) Date of Patent: Sep. 10, 2024

(54) DEVICE AND A METHOD FOR EMPTYING A SEWER WELL, A SEWER WELL AND A RECEIVER OF A SEWER PUMPING STATION

(71) Applicant: Marinus Lambertus Johannes Maria Verberne, Mierlo (NL)

(72) Inventors: Laurens Marinus Antonius Wilbertus Verberne, Naarden (NL); Robert Gerard Spaans, Brecht (BE)

(73) Assignee: Robert Gerard Spaans, Brecht (BE)

( * ) Notice: Subject to any disclaimer, the term of this patent is extended or adjusted under 35 U.S.C. 154(b) by 75 days.

(21) Appl. No.: 17/506,816

(22) Filed: Oct. 21, 2021

(65) Prior Publication Data

US 2022/0120076 A1 Apr. 21, 2022

(30) Foreign Application Priority Data

Oct. 21, 2020 (NL) ..... 2026724

(51) Int. Cl.
*E03F 5/22* (2006.01)
*E03F 5/10* (2006.01)

(52) U.S. Cl.
CPC ..... *E03F 5/22* (2013.01); *E03F 5/108* (2013.01)

(58) Field of Classification Search
CPC ..... E03F 5/22; E03F 5/108; E03F 7/00; E03F 5/16; E03F 5/14; B01D 17/00; B01D 17/02; B01D 17/0208; B01D 17/0214
USPC ..... 210/143, 513, 533, 538, 540, 800
See application file for complete search history.

(56) References Cited

U.S. PATENT DOCUMENTS 3,558,012 A * 1/1971 Weis ..... F04D 13/14 137/62
4,042,494 A * 8/1977 Stoyer ..... C02F 3/302 210/195.3
9,932,732 B1 4/2018 Batten
2016/0122209 A1* 5/2016 Newman, Jr. ..... B01D 17/0214 210/744

FOREIGN PATENT DOCUMENTS

DE 10031160 A1 1/2002
GB 2277557 A 11/1994

* cited by examiner

*Primary Examiner* — Claire A Norris
(74) *Attorney, Agent, or Firm* — Jeffrey D. Myers; Wilcox, Myers, & Jones PC

(57) ABSTRACT

A device for emptying a sewer well that comprises a lower relatively heavy fraction and an upper relatively light fraction, the device comprising a lower suction nozzle with a lower suction opening for removing the lower fraction, said lower suction nozzle being connected to a pump, characterized in that at a position remote from the lower suction nozzle the device comprises an upper suction nozzle for removing the upper fraction.

18 Claims, 4 Drawing Sheets

Figure 1:
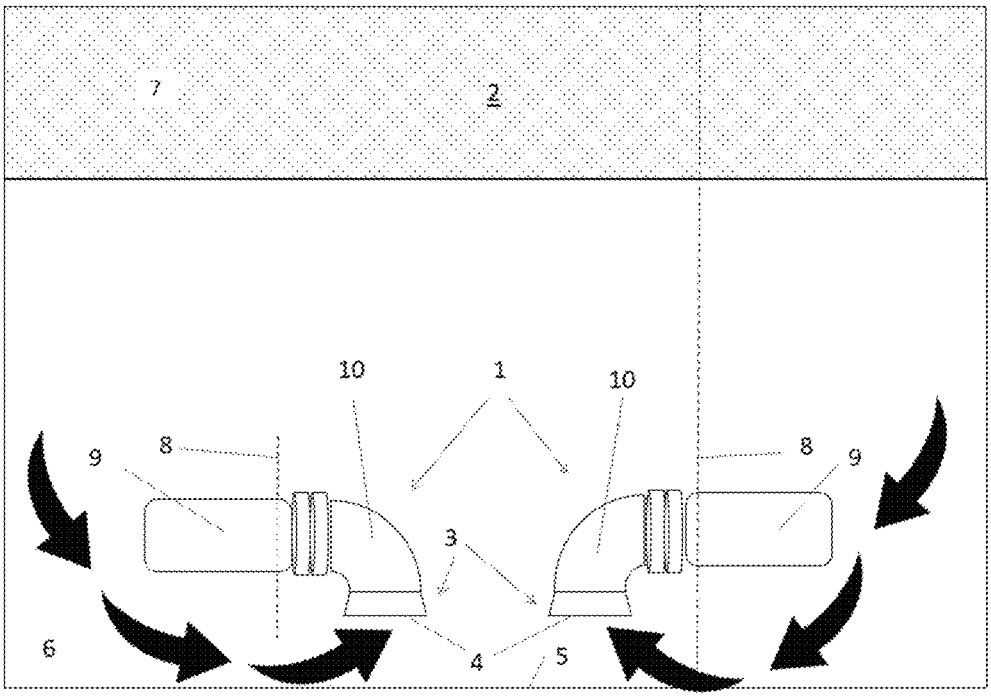

DEVICE AND A METHOD FOR EMPTYING A SEWER WELL, A SEWER WELL AND A RECEIVER OF A SEWER PUMPING STATION

This application claims priority to and the benefit of the filing of Netherlands Patent Application No. 2026724, filed on Oct. 21, 2020, and the specification and claims thereof are incorporated herein by reference.

The present invention relates to an apparatus and method for emptying a sewer well according to the preamble of claim 1. In particular, the invention relates to a method for removing waste water and solid, floating pollution such as fats from a sewer well. The term sewer well also refers in particular to the receiving cellar of a sewage pumping station. The waste water is usually fed from there to a high-pressure sewer line by means of a pump.

Sewer wells are used on a large scale. Sewage containing the contaminants from households and companies is collected in sewer wells. Sewer wells usually have a height of several meters, in which the waste water with the contaminants collects. The wastewater and contaminants with a specific gravity higher than water collect at the bottom of the sewer pit while fats and other contaminants with a specific gravity lower than water collect on top of the wastewater. Such a sewer well is known in the art. These wells are intermittently emptied, by suction nozzles connected to pumps, of the heaviest fraction, which mainly comprises water, which is located at the bottom. The extent to which the aqueous fraction is removed depends on the feed rate to the sewer well. The suction nozzles are located at the bottom of the sewer drain for this purpose.

The lighter fraction, consisting largely of fats and oils and hereinafter generally referred to as the fat layer although other materials and substances will also be present in that lighter fraction, is mainly above the water fraction, also referred to as the water layer or waste water or simply water, and is not removed through the suction nozzles. In the technique, this light fraction is removed from the well by external means and discharged in tankers. For this reason, it is not possible to remove the fat layer at short intervals. In practice, the fat layer can be removed at most once every two months, although in most cases the fat layer can be removed at most a few times a year. During this period, the thickness of the fat layer increases continuously, depending on the supply of fats and oils and other light materials in the sewer pit. It is clear that a thicker layer of fat offers less space for the storage of water in the sewer pit. At a high flow rate of water, the pump will therefore have to run continuously to drain the water and prevent the grease layer from rising above the sewer pit, which would lead to sewers overflowing into the sewer.

Such a known way of operating a sewer well can therefore easily lead to problems, in particular when there is a large supply of light materials in the well. Current technology cannot solve this problem.

There is therefore a need for an improved method and apparatus for emptying a sewer well.

In particular, it is an object of the invention to provide an improved method and device with which, in particular, the lighter, upper fraction of contaminants can also be removed from a sewer well.

It is also an object to provide a method and apparatus with which the lighter fraction can be removed together with the water fraction. It is also an object to provide a device and method with which the thickness of the light fraction can be kept at a value to be selected by a user.

In order to obtain at least one of the above-mentioned advantages, according to a first embodiment, the invention provides a device comprising the features of claim 1. This device has the advantage that both the lower relatively heavy fraction and the upper relatively light fraction can be removed from a sewer well in a simple manner. This prevents interruption of the operation of the sewer well.

It has also been found that with the device according to the invention an increased safety is obtained because flooding of the sewer is prevented. This also results in a more environmentally friendly use and application. Such a synergistic effect is a great advantage.

In addition to this, the advantage is obtained that the combined lower fraction and upper fraction waste stream containing the fats and oils can even be fed to a water purification plant for further degradation of the oils and fats. This is made possible because only a small amount of the upper fraction is removed concurrently with the lower fraction because the lower fraction is always supplied to the sewer to a much greater extent.

According to a first embodiment, the invention therefore relates to a device for emptying a sewer well that comprises a lower relatively heavy fraction and an upper relatively light fraction, the device comprising a lower suction nozzle with a lower suction opening for removing the lower fraction, said lower suction nozzle being connected to a pump, characterized in that at a position remote from the lower suction nozzle the device comprises an upper suction nozzle for removing the upper fraction.

In the present description and accompanying figures there is mention of a pump or a plurality of pumps. The drawing specifically shows two pumps in a sewer well. It is to be understood that any number of pumps may be provided, for example one pump or two pumps, but three pumps, four pumps, five pumps or six pumps, or even more pumps are within the protective scope of this description, claims and drawing as well.

According to a preferred embodiment, the upper suction nozzle is connected by means of an upper discharge piping to a lower discharge conduit connected to the lower suction opening for simultaneously removing lower fraction and upper fraction by means of the pump. This provides the advantage that a common conduit is fed to the pump, through which both the lower fraction and the upper fraction are transported to the pump. It is herein particularly preferred that the coupling of the upper discharge pipe to the lower discharge pipe takes place in the sewer well, which enables a simple construction, since in that case only a single conduit and passage through a wall of the sewer well is required.

In such embodiment, the pump may preferably be positioned downstream of the suction nozzle, allowing for a clean set up in the sewer well, since the pump may be positioned outside the sewer well, in a so-called dry area.

Preferably, the upper suction nozzle is connected to an upper discharge conduit, the upper discharge conduit comprising a discharge opening near the suction opening of the lower suction nozzle for simultaneously removing lower fraction and upper fraction through the lower discharge piping by means of the pump. In such embodiment, the pump action ensures a draw near the lower suction opening such that any fluid inside the upper discharge conduit is drawn in as well, allowing removal of the upper fraction through the upper discharge conduit and subsequently through the lower suction opening towards the pump and the lower discharge piping.

In such embodiment, the pump may be positioned in the suction nozzle.

It is furthermore preferred that an operable control valve is provided in the upper discharge conduit for selectively opening or closing the upper discharge conduit. As a result, the discharge of the upper fraction will have to take place less often than the discharge of the lower fraction. The supply of light fraction (oils and fats) is almost always significantly less than the supply of heavy fraction (water), so that a partial closure of the upper discharge conduit provides an advantage in terms of wear and constant drainage.

Preferably, the upper suction nozzle comprises at least one supply opening, wherein the presence of several supply openings for introducing the light fraction via the suction nozzle into the upper discharge conduit is also a possibility and whereby the advantage of a uniform discharge of the light fraction can be obtained. Particularly when the light fraction forms a continuous layer on the water, it is preferable to extract this light fraction over, for example, the entire circumference, or a large part of the circumference, via several feed openings.

In order to prevent objects that are too large from being sucked into the upper suction nozzle and thereby into the upper discharge conduit, it is preferred that the at least one supply opening of the upper suction nozzle has a width of a maximum of 15 cm, preferably a maximum of 12 cm, more preferably up to 8 cm. This prevents the risk of clogging of the device.

In order to provide a suitable discharge of the contents of the sewer well, the pump is preferably connected to a pressure sewer.

A suitable embodiment is furthermore obtained when the upper suction nozzle is positioned at a fixed height above the lower suction nozzle. As a result, it is clear at all times that a sufficiently heavy fraction is present when visual inspection shows that the light fraction is substantially absent. On the other hand, a variable height is advantageous if the level of the waste water and other contaminants varies regularly and a discharge of the fats and the like must be possible at all times. The variable height can be obtained by means of a floating body to automatically regulate the height on the basis of the water level and/or the fats or greases and the like or by means of an actuator that can be controlled by a controller.

The size of the at least one inlet opening of the upper suction nozzle is preferably adapted for the passage of PET bottles and objects of similar or different dimensions to the upper discharge conduit. Such bottles can be processed without any problems by the pumps used in sewage wells. These bottles float on the water in the light fraction because of their inherently low specific gravity.

The invention further relates to a sewer well, comprising a device according to the invention and as described in particular in one or more of claims 1 to 12.

In addition, the invention relates to a receiving cellar of a sewage pumping station, comprising a device according to the invention and as described in particular in one or more of claims 1 to 12.

According to another aspect of the invention, it relates to a method for emptying a sewer well that comprises a lower relatively heavy fraction and an upper relatively light fraction, comprising sucking at least a part of the lower fraction by means of a pump through a lower suction nozzle with a lower suction opening near the bottom of the sewer well, characterized in that the method further comprises the step of sucking at least a part of the upper fraction by means of the pump through an upper suction nozzle located at a position remote from the lower suction nozzle. The advantages as mentioned above with regard to the device according to the invention are hereby obtained.

It is furthermore preferred in the method according to the invention that the lower suction nozzle is connected with a lower discharge piping to the pump for removing the lower fraction through the lower discharge piping to the pump, the method further comprising the step of removing the upper fraction to the lower discharge piping by means of an upper discharge conduit from the upper suction nozzle for the simultaneous removal of lower fraction and upper fraction by means of the pump. The light fraction is diluted by the simultaneous removal of the lower aqueous fraction so that the combined effluent of lower and upper fraction can be fed to an, optional biological, purification plant.

In order to reduce the amount of the upper fraction, for example to limit or keep limited the concentration of oils and fats in the effluent, it is preferred that the method comprises the step of temporarily opening and closing the upper discharge conduit by means of a control valve to allow or prevent removal of the upper fraction from the sewer well, respectively.

A joint discharge of the combined discharge stream can be obtained in particular in an advantageous manner by supplying the fractions removed from the sewer well to a pressure sewer by means of the pump.

As mentioned above, the method according to the invention offers the advantage that it makes it possible to transport the fractions removed from the sewer well by means of the pump to a sewage treatment plant. The light upper fraction, which mainly consists of oils and fats, in a concentration obtained by this method, such as that exists in sewage wells in urban areas, can easily and without adverse effects be sent together with the aqueous lower fraction to an, optionally biological, sewage treatment plant. The organic substances are converted into, among other things, methane gas that can be captured and used, for example, for industrial processes.

The valve for shutting off the upper conduit is located in the sewer well. For this reason, it is preferred that the actuation of the control valve is performed hydraulically, especially with compressed air.

In practice, the lower suction nozzle is directed towards the bottom of the sewer pit. It is coupled to or integrated into an approximately 90 degree elbow that connects to or merges into the lower discharge conduit. The upper suction nozzle may advantageously have a basket construction with openings through which the light upper fraction is passed and transferred towards the bottom of the well. Preferably the upper discharge conduit is coupled to the elbow of the lower suction nozzle, whereby direct displacement of the upper fraction into the lower discharge stream is obtained. Preference is therefore given to a method comprising suctioning the lower fraction from the sewer well in a vertically upward direction by means of the lower suction nozzle, deflecting the lower fraction by means of a bend in a horizontal direction or at most 90°, and supplying the upper fraction to the bend.

Finally, preference is given to a method comprising supplying rinsing water to the upper discharge conduit for joint removal of the upper fraction and rinsing water through the upper discharge conduit. This lowers the concentration of fats and oils in the effluent, so that in the case of large quantities of oils and fats that have to be removed, the concentration thereof in the effluent is sufficiently low to be able to be offered to an, optionally biological, sewage treatment plant.

Figure 2:
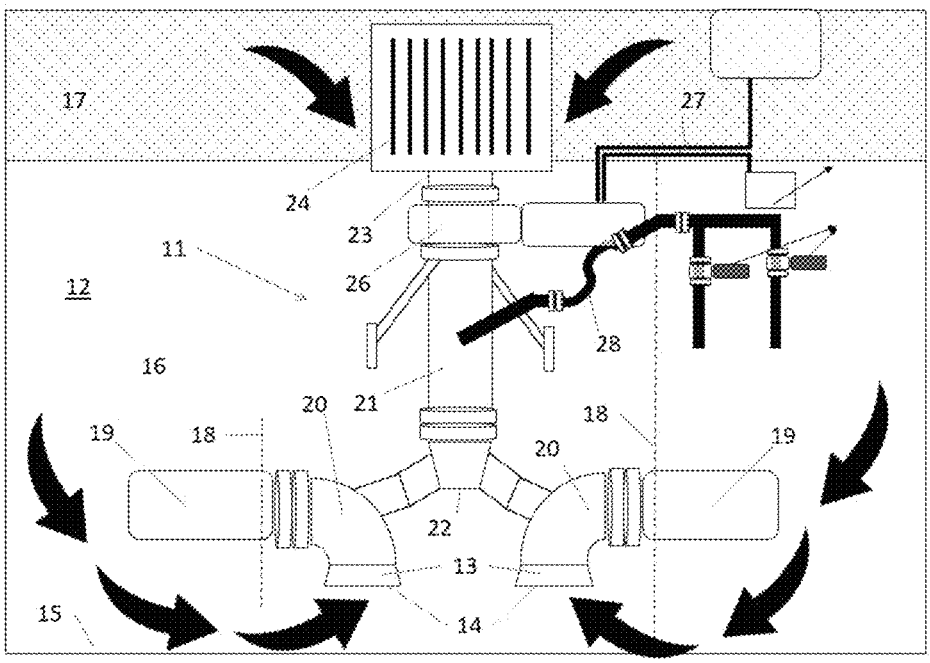
Figure 3:
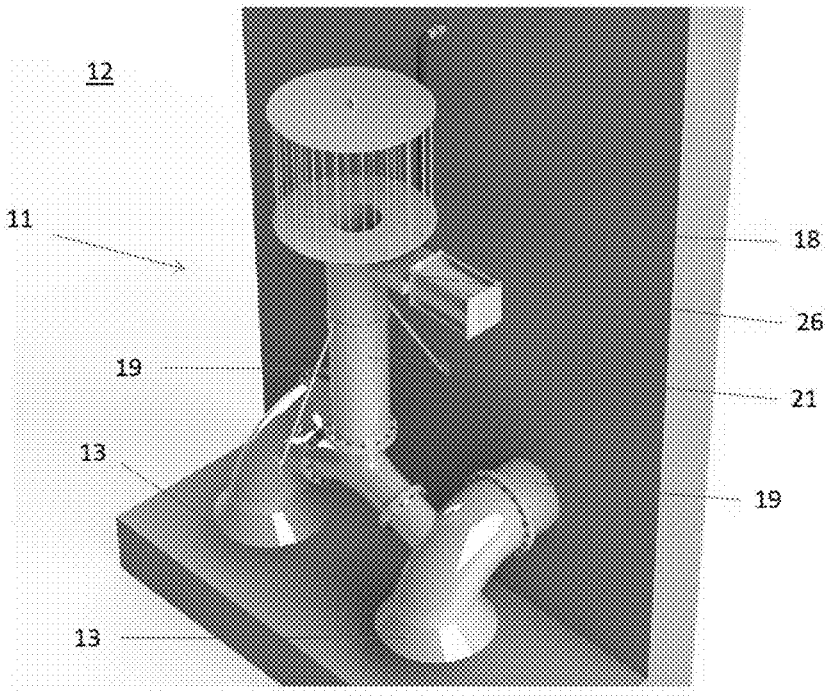
Figure 4:
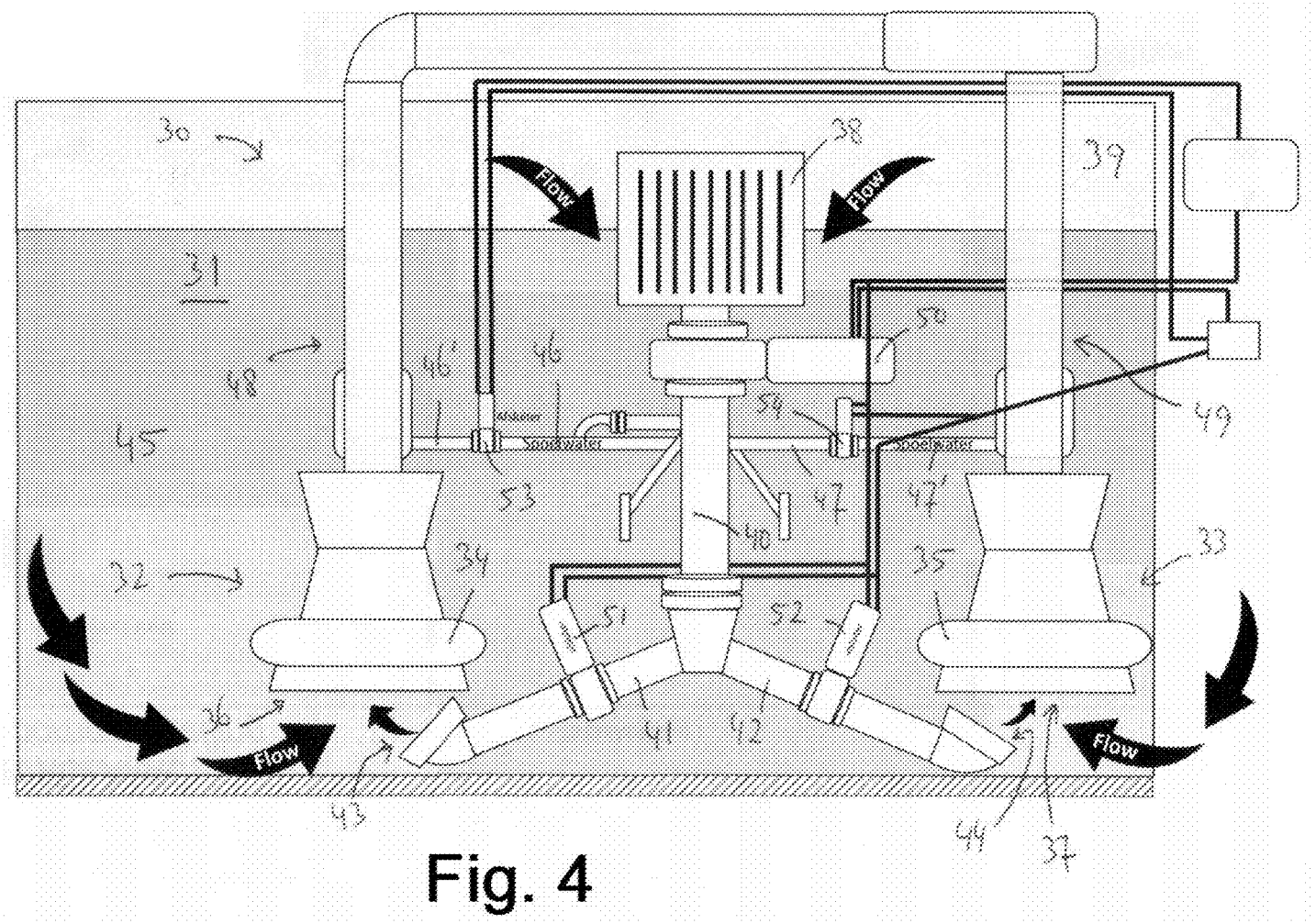

The invention will be explained in more detail below with reference to a drawing. The drawing hereby shows in:

FIG. 1 a schematic side view of a device according to the prior art,

FIG. 2 a schematic side view of a device according to the invention,

FIG. 3 a schematic perspective view of a device according to the invention,

FIG. 4 a schematic side view of an alternative embodiment of a device according to the invention.

In the figures, the same parts are designated by the same reference numerals. However, the parts necessary for a practical implementation of the invention are not all shown because of the simplicity of the representation.

FIG. 1 schematically shows a device 1 for removing the contents of a sewer well 2 according to the prior art. This known and 5 generally used device 1 comprises one or more, in this case two, suction nozzles 3. The supply openings or suction apertures 4 of the suction nozzles are directed towards the bottom 5 of the sewer well 2. The contents of the sewer well 2 consist of a lower relatively heavy fraction 6 and an upper relatively light fraction 7. The lower fraction 6 consists largely of water and the upper relatively light fraction 7 consists largely of fats and oils. In FIG. 1, a wall 8 of the sewer well 2 is schematically indicated by dotted lines 8. The suction nozzles of the device 1 are passed through the wall 8 by means of discharge pipes 9 in order to be able to discharge the lower fraction from the sewer well 2. In the embodiment shown, the suction nozzles 3 form part of a bend 10 which is coupled to the discharge pipes, such that the discharge pipes can be guided horizontally through the wall 8 in a simple manner.

FIG. 2 schematically shows a device 11 according to the invention in a sewer well 12. In the embodiment shown, the device 11 basically comprises the system known from the prior art, with two suction nozzles 13 in the embodiment shown. The suction nozzles 13 have supply openings or suction openings 14 directed towards the bottom 15 of the sewer well 12. The content of the sewer well 12 consists of a lower relatively heavy fraction 16 and an upper relatively light fraction 17. The lower fraction 16, just as in the sewer well 2 shown in FIG. 1, here also exists largely of water and the upper relatively light fraction 17 consists largely of fats and oils. In FIG. 2, a wall 18 of the sewer well 12 is schematically indicated by dotted lines 18. The suction nozzles 13 of the device 11 are passed through the wall 18 by means of lower discharge conduits 19 in order to enable the contents of the sewer well 12 to be discharged. In the embodiment shown, the suction 35 nozzles 13 form part of a bend 20 which is coupled to the lower discharge conduits 19, such that the lower discharge conduits 19 can be guided through the wall 18 in a simple manner with a slight incline. Actually, the lower suction nozzles 13 and the bend 20 actually form part of the lower discharge piping 29. In this description, the term lower discharge piping 29 relates to any part of the conduits from the suction openings 14 and further including the bend 20 and the lower discharge conduits 19.

In addition to the suction nozzles 13 and the lower discharge conduits 19, an upper discharge conduit 21 is provided which is coupled with a first end 22 to the elbow 20 and which is coupled with an upper suction nozzle 24 at another end. a position where it can discharge the upper fraction 17 when the sewer pit 12 is sufficiently filled. A suction effect is applied to the lower suction nozzle 13 and the upper suction nozzle 24 by means of a pump. The lower fraction 16 is discharged via the lower suction nozzle 13 and the light fraction 17 is discharged via the upper suction nozzle 24. The amount of upper fraction 17 that is discharged together with the lower fraction 16 can be controlled by, for example, suitably selecting the diameter of the upper discharge conduit 21 relative to the diameter of the lower discharge conduits 19. If it is chosen to be smaller than that of the lower discharge conduit 19, the amount of the upper fraction 17 will be significantly smaller than the amount of the lower fraction 16 because of the pressure difference that occurs.

Also, an adjustable valve 26 can be provided in the upper discharge conduit 21, whereby the passage through the upper discharge conduit 21 can be opened or closed to permit or disallow the discharge of light fraction 17, respectively. This allows the concentration of oils and fats in the discharge stream through the lower discharge conduit or discharge conduits 19 to be accurately controlled.

In FIG. 2, a rinse water supply line 28 is clearly shown for supplying rinse water to the upper discharge conduit for joint removal of the upper fraction and rinse water through the upper discharge conduit. This reduces the chance of clogging.

The valve 26 is preferably hydraulically operable to prevent electrical disturbances in the aqueous environment of the sewer well 2.

FIG. 3 shows a schematic perspective view of the device 11 according to the invention. Here too, two suction nozzles 13 are shown, each of which is coupled to a lower discharge conduit 19. Both discharge conduits 19 are parallel and lead through a wall 18 of the sewer well 12. A pump (not shown) is located in a dry installation room on the other side of the wall 18. The actuation of the control valve or shut-off valve 26 is located adjacent to the upper discharge conduit 21 and is hydraulically actuated via a hydraulic conduit. The hydraulic conduit also leads through wall 18 to the dry installation room, where all electronics for controlling the pumps and the control valve 26 are located.

FIG. 4 shows an alternative embodiment of a device 30 according to the present invention. In this embodiment all parts for removal of lower and upper fraction are situated inside the sewer well 31. In the embodiment shown, the device 30 comprises two lower suction nozzles 32, 33. Each suction nozzle 32, 33 is provided with a pump 34, 35 shortly downstream from the lower suction opening 36, 37 of each nozzle 32, 33. The pumps yield a suction force for sucking in lower fraction from the sewer well 31. The upper suction nozzle 38 for removing upper fraction 39 is connected to an upper discharge conduit 40 that splits into two sub-conduits 41, 42, each sub-conduit ending in an outlet opening 43, 44 close to the lower suction opening 36, 37 of each lower suction nozzle, respectively. As a result, the pump action sucks in lower fraction 45 and concurrently induces a suction force in the upper discharge conduit 40 resulting in removal of upper fraction 39 through the upper suction nozzle 38 towards and into each pump 34, 35.

As a supporting feature, a flushing conduit 46, 47 is provided for adding flushing water into the upper discharge conduit 40, adding in an increased water flow towards the outlet openings of the sub-conduits. A flushing conduit 46', 47', optionally the same flushing conduit 46, 47 as mentioned previously, may be connected to the lower discharge piping 48, 49, preferably at a position downstream of the pump 34, 35, for adding in removal of lower 45, 35 and optionally upper 39, fraction.

Valves 50, 51, 52 may be provided in any of the upper discharge conduit 40 and the sub-conduits 41, 42, respectively, for closing or opening these conduits. Also, the flushing conduits may be provided with valves 53, 54 for closing or opening the flushing conduits at will.

The invention also extends to any combination of features described above independently of each other.

The invention is not limited to the embodiments described above and shown in the figures. The invention is limited only by the appended claims.

The invention claimed is:

1. A sewer pumping station device for emptying a sewer well that comprises a lower relatively heavy fraction and an upper relatively light fraction, the device comprising a lower suction nozzle with a lower suction opening for removing the lower fraction, said lower suction nozzle being connected to a pump via a lower discharge conduit of a lower discharge piping connected to the lower suction opening, wherein at a position remote from the lower suction nozzle the device comprises an upper suction nozzle for removing the upper fraction said upper suction nozzle being connected to an upper discharge conduit, wherein either the upper suction nozzle is connected by means of the upper discharge conduit to the lower discharge conduit of the lower discharge piping connected to the lower suction opening for simultaneously removing the lower fraction and the upper fraction by means of the pump, or or the upper discharge conduit comprises a discharge opening at the lower suction opening of the lower suction nozzle for simultaneously removing the lower fraction and the upper fraction through the lower discharge piping by means of the pump, and wherein the diameter of the upper discharge conduit is smaller than that of the lower discharge conduit, such that during said simultaneously removing an amount of the upper fraction will be smaller than an amount of the lower fraction because of pressure difference that occurs.

2. The sewer pumping station device as claimed in claim 1, wherein the pump is positioned downstream of the lower suction nozzle.

3. The sewer pumping station device as claimed in claim 1, wherein the pump is positioned in the lower suction nozzle.

4. The sewer pumping station device as claimed in claim 1, wherein an operable control valve is provided in the upper discharge conduit for selectively opening or closing the upper discharge conduit.

5. The sewer pumping station device as claimed in claim 1, wherein the upper suction nozzle comprises at least one supply opening.

6. The sewer pumping station device as claimed in claim 5, wherein the at least one supply opening of the upper suction nozzle has a width of maximum 15 cm.

7. The sewer pumping station device as claimed in claim 5, wherein the at least one supply opening of the upper suction nozzle is adapted for passage of PET bottles and objects of similar dimensions to the upper discharge conduit.

8. The sewer pumping station device as claimed in claim 1, wherein the pump is connected to a pressure sewer.

9. The sewer pumping station device as claimed in claim 1, wherein the upper suction nozzle is positioned at a fixed height above the lower suction nozzle.

10. The sewer pumping station device as claimed in claim 1, wherein the upper suction nozzle is positioned at a variable height above the lower suction nozzle.

11. A sewer well comprising a sewer pumping station device according to claim 1.

12. A receiving cellar of a sewage pumping station, comprising a sewer pumping station device according to claim 1.

13. A method for emptying a sewer well of a sewer pumping station with the sewer pumping station device according to claim 1, wherein the sewer well comprises a lower relatively heavy fraction and an upper relatively light fraction, the method comprising the step of sucking at least a part of the lower fraction by means of the pump through the lower suction nozzle with the lower suction opening near a bottom of the sewer well, wherein the method further comprises the step of sucking at least a part of the upper fraction by means of the pump through an upper suction nozzle located at a position remote from the lower suction nozzle, wherein the lower suction nozzle is connected with the lower discharge piping to the pump for removing the lower fraction through the lower discharge piping to the pump, the method further comprising the step of removing the upper fraction to the lower discharge piping by means of the upper discharge conduit from the upper suction nozzle for the simultaneous removal of the lower fraction and the upper fraction by means of the pump, and wherein due to the diameter of the upper discharge conduit being smaller than that of the lower discharge conduit, during said simultaneously removing, an amount of simultaneously removed upper fraction is smaller than an amount of simultaneously removed lower fraction because of pressure difference that occurs.

14. The method as claimed in claim 13, further comprising the step of supplying the lower and upper fractions removed from the sewer well to a pressure sewer by means of the pump.

15. The method according to claim 13, further comprising the step of transporting the lower and upper fractions removed from the sewer well by means of the pump to a sewage treatment plant.

16. The method according to claim 13, further comprising the steps of suctioning the lower fraction from the sewer well in a vertically upward direction by means of the lower suction nozzle, deflecting the lower fraction by means of a bend and supplying the upper fraction at the bend.

17. The method according to claim 13, comprising supplying flushing water at an upstream position to the upper discharge conduit for concurrent removal of the upper fraction and flushing water at a downstream position through the upper discharge conduit.

18. The method according to claim 13, comprising supplying flushing water to the upper discharge conduit for flushing flushing water therethrough.

* * * * *